US006213077B1

(12) United States Patent
Horii

(10) Patent No.: US 6,213,077 B1
(45) Date of Patent: Apr. 10, 2001

(54) RESONATOR TYPE SILENCER FOR AUTOMOTIVE ENGINE

(75) Inventor: Kiyohide Horii, Saitama (JP)

(73) Assignee: Tennex Corporation, Tokyo (JP)

( * ) Notice: Subject to any disclaimer, the term of this patent is extended or adjusted under 35 U.S.C. 154(b) by 0 days.

(21) Appl. No.: 09/521,886

(22) Filed: Mar. 9, 2000

(51) Int. Cl.[7] ..... E04F 17/04

(52) U.S. Cl. ..... 123/184.57; 181/229

(58) Field of Search ..... 123/184.57; 181/204, 181/205, 229

(56) References Cited

U.S. PATENT DOCUMENTS

| | | | | |
|---|---|---|---|---|
| 5,295,602 | | 3/1994 | Swanson . | |
| 5,349,141 | * | 9/1994 | Horibe et al. | 181/229 |
| 5,647,314 | * | 7/1997 | Matsumura et al. | 123/184.57 |
| 5,725,624 | | 3/1998 | Ernst et al. . | |
| 6,092,499 | * | 7/2000 | Spannbauer | 123/184.57 |

FOREIGN PATENT DOCUMENTS

| | | | | |
|---|---|---|---|---|
| 147 61 96 | | 7/1969 | (DE) . | |
| 432 67 31 | | 2/1995 | (DE) . | |
| 198 11 051 | | 9/1999 | (DE) . | |
| 0 897 060 | | 2/1999 | (EP) . | |
| 27 45038 | | 8/1997 | (FR) . | |
| 358124057 | * | 7/1983 | (JP) | 123/184.57 |
| 6-60764 | | 8/1994 | (JP) . | |

* cited by examiner

*Primary Examiner*—Marguerite McMahon
(74) *Attorney, Agent, or Firm*—Foley & Lardner

(57) ABSTRACT

A resonator type silencer connected to an air intake duct of an automotive internal combustion engine. The resonator type silencer comprises a first case having an open end section. A second case is fabricated separate from the first case. The second case has an open end section which is joinable with the open end section of the first case. The open end section of the first case includes an end edge portion having a linear projection extending along the end edge portion. The linear projection has an inclined face extending along the end edge portion and sloped down in a direction toward a surface of the open end section. The open end section of the second case includes an end wall portion. A guide wall is integral with the end wall portion and extending along an end edge portion of the open end section to define a groove extending along the end edge portion. A seal edge portion is formed at a surface of the guide wall and extends along the end edge portion of the open end section of the second case so as to define a part of the groove. The seal edge portion is contactable with the inclined face of the linear projection of the end edge portion of the first case. Additionally, an engagement mechanism is further provided in the resonator type silencer and includes a projecting section formed integral with one of the first and second cases. A receiving section is provided for receiving the projecting section so that the projecting section and the receiving section are engageable with each other, the receiving section being formed integral with the other of the first and second cases.

7 Claims, 7 Drawing Sheets

RESONATOR TYPE SILENCER FOR AUTOMOTIVE ENGINE

BACKGROUND OF THE INVENTION

1. Field of the Invention

This invention relates to improvements in a resonator type silencer which is connected to an air intake duct of an internal combustion engine of an automotive vehicle in order to suppress vibration of intake air to be supplied to the engine.

2. Description of the Prior Art

It is well known that generally box-shaped resonator type silencer having a certain volume is disposed to be connected to an air intake duct of an automotive internal combustion engine. The resonator type silencer functions to suppress vibration of intake air by causing air inside the resonator type silencer to make resonance with the intake air vibration. Such a resonator type silencer is usually formed of plastic and is a large-sized part. Accordingly, the resonator type silencer includes upper and lower cases which are independently fabricated. The upper and lower cases are joined to each other to form the resonator type silencer, in such a manner that the open end sections of them are thermally welded or welded upon vibration under a state where the open end sections are brought into contact with each other. Otherwise, the open end sections of the upper and lower cases may be joined by means of clips, screws or the like. Such a technique is disclosed in Japanese Utility Model Provisional Publication No. 6-60764.

However, difficulties have been encountered in the above conventional technique. That is, a large-sized facility for the above-mentioned welding is required thereby increasing a plant and equipment investment. Additionally, in case that the upper and lower cases are joined by means of the clips, screws or the like, such separate parts for joining are necessary, thereby raising a production cost. Furthermore, a slight clearance tends to be formed between the open end sections of the upper and lower cases. This clearance will lower a suppression effect for intake air vibration inside the air intake duct of the engine.

SUMMARY OF THE INVENTION

It is an object of the present invention to provide an improved resonator type silencer for an automotive internal combustion engine, which can effectively overcome drawbacks encountered in similar conventional resonator type silencers.

Another object of the present invention is to provide an improved resonator type silencer for an automotive internal combustion engine, which is high in suppression effect for intake air vibration in an air intake duct of the engine while lowering a production cost of the resonator type silencer.

A further object of the present invention is to provide an improved resonator type silencer for an automotive internal combustion engine, by which upper and lower cases constituting the resonator type silencer can be readily joined to each other maintaining a tight seal condition of the resonator type silencer, without using any facility or members for connecting the upper and lower cases.

A resonator type silencer according to the present invention comprises a first case having an open end section. A second case is fabricated separate form the first case. The second case has an open end section which is joinable with the open end section of the first case. The open end section of the first case includes an end edge portion having a linear projection extending along the end edge portion. The linear projection has an inclined face extending along the end edge portion and sloped down in a direction toward a surface of the open end section. The open end section of the second case includes an end wall portion. A guide wall is integral with the end wall portion and extending along an end edge portion of the open end section to define a groove extending along the end edge portion. A seal edge portion is formed at a surface of at least one of the guide wall and the end wall portion and extends along the end edge portion of the open end section of the second case to define a part of the groove. The seal edge portion is contactable with the inclined face of the linear projection of the end edge portion of the first case. Additionally, an engagement mechanism is further provided in the resonator type silencer and includes a projecting section formed integral with one of the first and second cases. A receiving section is provided for receiving the projecting section so that the projecting section and the receiving section are engageable with each other, the receiving section being formed integral with the other of the first and second cases.

The thus arranged resonator type silencer can be readily assembled by bringing the open end sections of the upper and lower cases into contact with each other in a manner to insert the linear projection of one case into the groove formed in the other case, then by engaging the engagement mechanism formed between the upper and lower cases. This makes it unnecessary to use a large-sized facility or separate members for joining the lower and upper cases, greatly facilitating production of the resonator type silencer. Upon such assembly of the resonator type silencer, a labyrinth structure formed by the linear projection and the groove is provided between the open end sections of the lower and upper cases, while an edge contact is made between the seal edge portion and the inclined face of the linear projection. As a result, an air-tight seal can be securely maintained between the open end sections of the lower and upper cases.

BRIEF DESCRIPTION OF THE DRAWINGS

In the drawings, like reference numerals designate like parts and elements throughout all figures, in which.

DETAILED DESCRIPTION OF THE INVENTION

Figure 1:
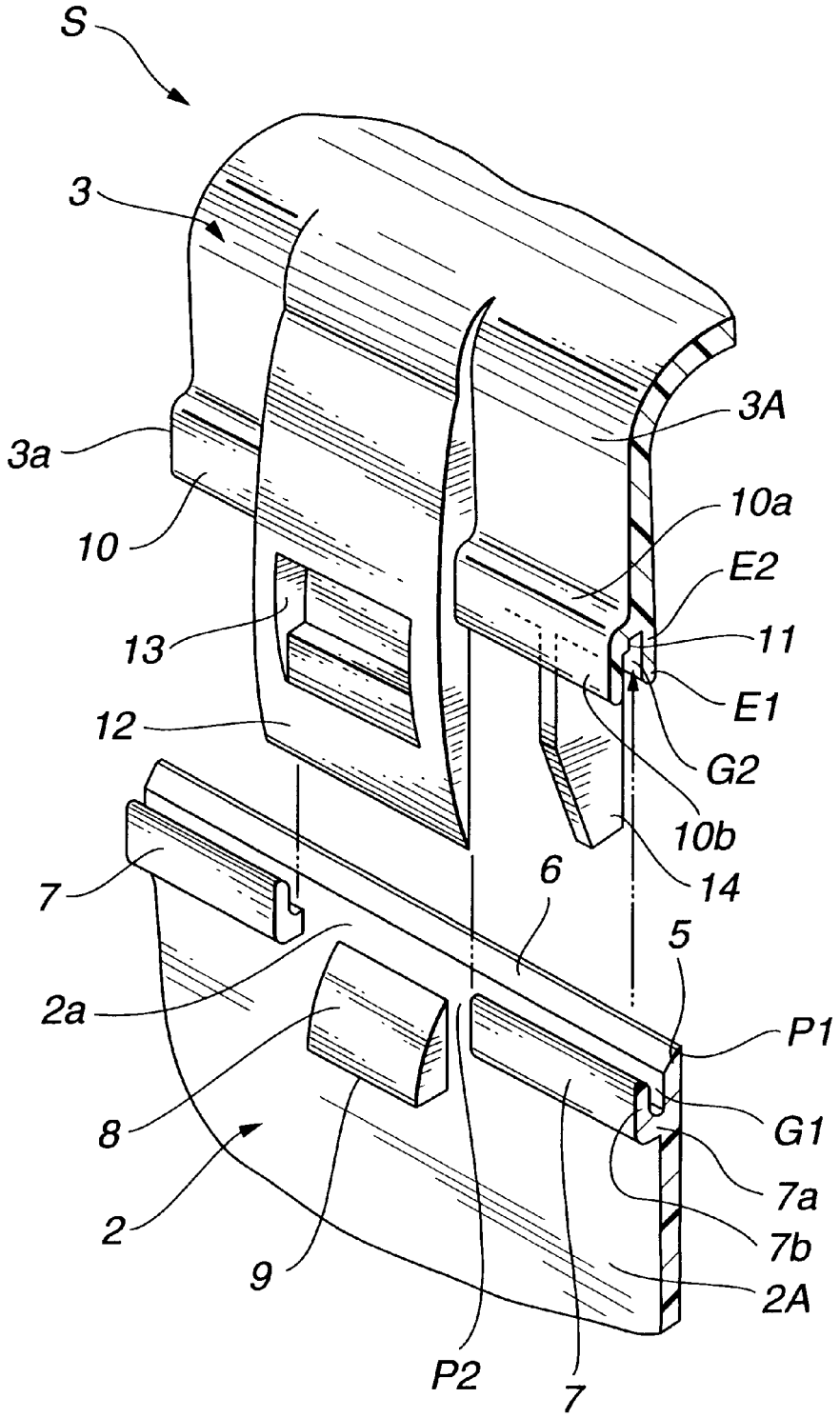
FIG. 1 is a fragmentary perspective view of an essential part of a first embodiment of a resonator type silencer according to the present invention.

Referring now to FIGS. 1 to 5, an embodiment of a resonator type silencer according to the present invention is illustrated by the reference character S. The resonator type silencer S is connected to an air intake duct of an internal combustion engine of an automotive vehicle, though not shown. The air intake duct forms part of an intake system of the engine. The resonator type silencer S is provided with a connection duct 1 through which the inside of the resonator type silencer S is communicated with the air intake duct through which intake air flows into the engine. The resonator type silencer S comprises a lower case 2 which is formed generally cup-shaped and has a generally rectangular cross-section in a plane perpendicular to the longitudinal axis of the lower case. The lower case 2 is relatively deep or large in axial length. An upper case 3 is joined at its lower end part with the lower case 2 at an upper end part, maintaining a tightly closed state. The upper case 3 is formed generally cup-shaped and has a generally rectangular cross-section in a plane perpendicular to the axis of the upper case 3. The upper case 3 is relatively shallow or small in axial length. The connection duct 1 is formed integral with the upper case 3 and extends from an upper wall 3*p* of the upper case 3. The lower case 2 is integrally provided at its outer surface with engagement projections 4, 4 through which the lower case 2 is fastened to a vehicle body of the automotive vehicle. Each of the lower and upper cases 2,3 is formed of plastic such as thermoplastic resin. Examples of the thermoplastic resin are polyethylene, and polyamide. Such thermoplastic resin may contain filler. The whole body of the resonator type silencer S is formed generally box-shaped so as to have a certain volume.

The lower case 2 includes an open end section 2*a* located at the upper end part thereof and peripherally formed endless. The open end section 2*a* includes an end edge portion P1 which laterally extends endless. A linear projection 5 forms part of the end edge portion P1 and extends along the periphery of the lower case 2. The projection 5 has an inclined face 6 which extends along the periphery of the lower case 2 and sloped down in a direction from the inner surface to outer surface of the open end section 2*a*.

Additionally, a plurality of hook-like guide walls 7 are formed integral with the open end section 2*a* and projected from the surface of a end wall portion P2 of the open end section 2*a*. Each hook-like guide wall 7 laterally extends along the end edge portion P1 and has a generally L-shaped cross-section. More specifically, the hook-like guide wall 7 includes an outward projecting portion 7*a* which is integral at its base part with the end wall portion P2 of the lower case 2. The outward projecting portion 7*a* laterally extends along the end edge. An upward projecting portion 7*b* is integral at its lower part with an tip end part of the outward projecting portion 7*a*, so that a groove G1 extending along the end edge portion P1 is formed between the outer surface of the end wall portion P2 and the upwardly projecting portion 7*b*. The adjacent hook-like guide walls 7, 7 are formed laterally aligned and separate from each other.

A plurality of generally wedge-shaped stopper projections or projecting sections 9 are integrally formed at the outer surface of the open end section 2*a* of the main body 2A of the lower case 2. Each stopper projection 9 is located between the adjacent hook-like guide walls 7, 7. Each stopper projection 9 forms part of an engagement mechanism (not identified) has an inclined face 8 which is sloped down in a direction toward the end edge portion P1.

The upper case 3 includes an open end section 3*a* located at the lower end part of the upper case 3 and peripherally extents endless. The open end section 3*a* includes an end edge portion E1 which extends endless to extend along the periphery of the upper case 3. A laterally extending hook-like guide wall 10 is formed integral with an end wall portion E2 of the open end section 3*a* and projected from the surface of the end wall portion E2. The hook-like guide wall 10 peripherally extends along the end edge portion E1 and has a generally L-shaped cross-section. More specifically, the hook-like guide wall 10 includes an outward projecting portion 10*a* which is integral at its base part with the end wall portion E2 of the upper case 3. The outward projecting portion 10*a* peripherally extends along the end edge portion E1. A downward projecting portion 10*b* is integral at its upper part with an tip end part of the outward projecting portion 10*a*, so that a groove G2 extending along the end edge portion E1 is peripherally formed between the outer surface of the end wall portion E2 and the downward projecting portion 10*b*. Additionally, a peripherally extending seal edge portion 11 is formed a the inner surface of the hook-like guide wall 10. More specifically, the seal edge portion 11 is located to extend along a linear portion (not identified) at which the outward projecting portion 10*a* and the downwardly projecting portion 10*b* is integral with each other, so that the seal edge portion 11 can be brought into contact with the inclined face 6 of the linear projection 5 of the lower case 2 when the linear projection 5 is inserted into the groove G2 of the upper case 3.

A plurality of tongue-like locking piece or receiving sections 12 are formed integral with the open end section 3*a* and project downward from the open end section 3*a* by a certain length. Each locking piece section 12 forms part of a locking or engagement mechanism (not identified) is located corresponding to each stopper projection 9 of the lower case 2. Each locking piece section 12 is formed with a window or opening into which the stopper projection 9 can be fitted.

Figure 4:
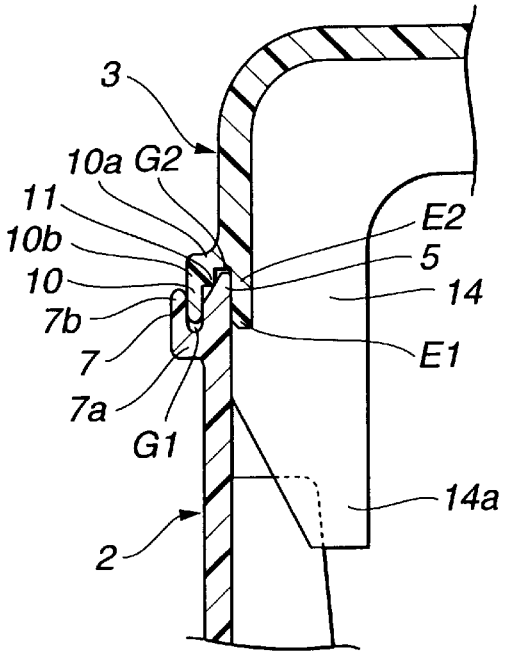
FIG. 4 is a cross-sectional view taken in the direction of the arrows substantially along the line A—A of FIG. 3.

A plurality of ribs 14 are formed integral with the open end section 3*a* of the upper case 3 at the inner surface so as to function to reinforce the wall of the end wall portion E2 defining the groove G2. Each rib 14 is plate-like and perpendicular to the inner surface of a main body 3A of the upper case 3. Each rib 14 is integral with the end edge portion E1 and extends inward as best shown in FIG. 4. Each rib 14 further extends downward from the end wall portion E2 by a certain length so as to form a downward projecting part 14*a*. The downward projecting part 14*a* has a base section whose edge is formed flush with the outer surface of the end wall portion E2, so that the edge of the base section is brought into contact with the inner surface of the open end section 2*a* of the lower case 2.

Figure 2:
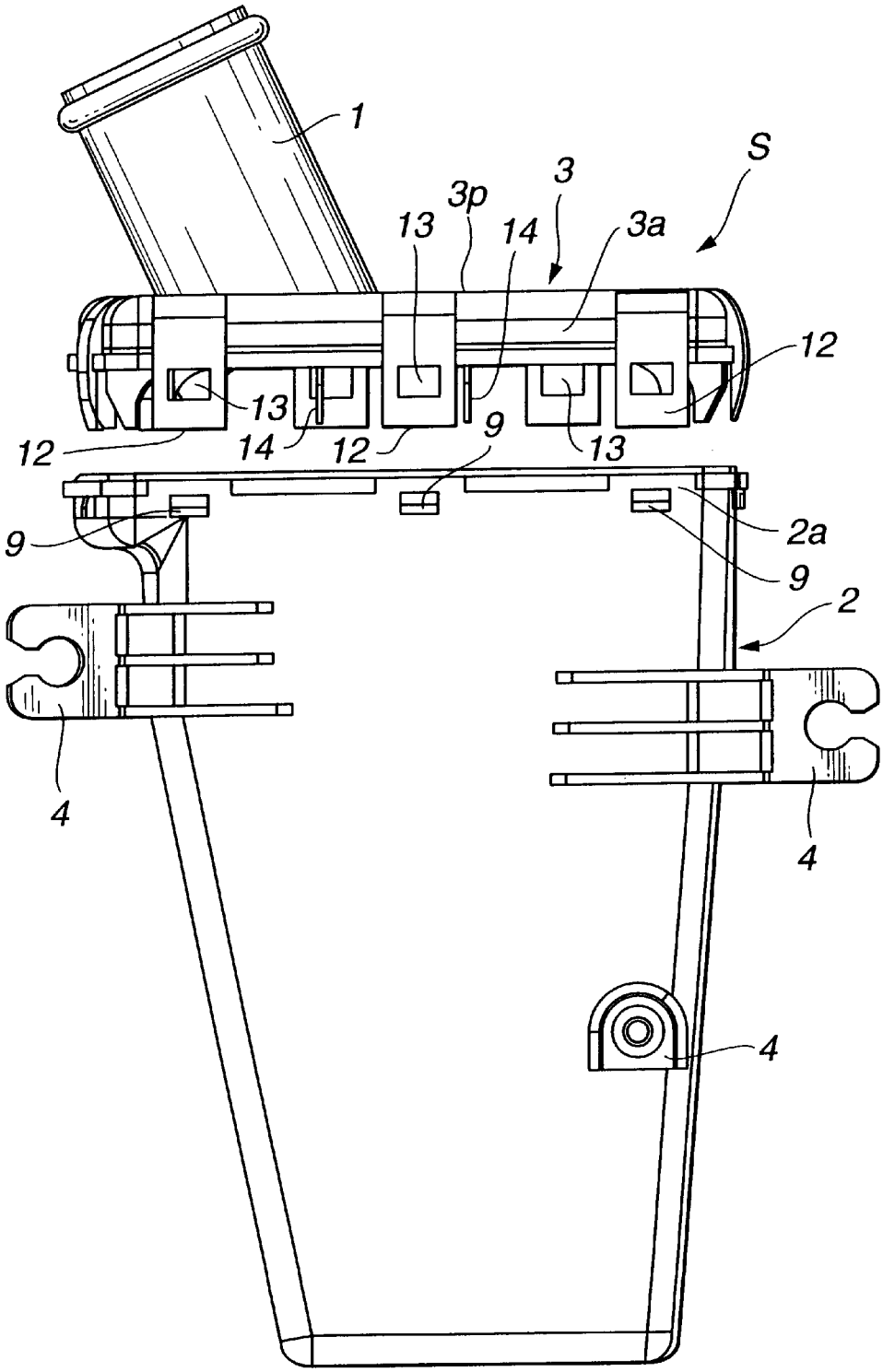
FIG. 2 is a front elevation of the resonator type silencer of FIG. 1, showing a state made before assembly of the resonator type silencer.
Figure 3:
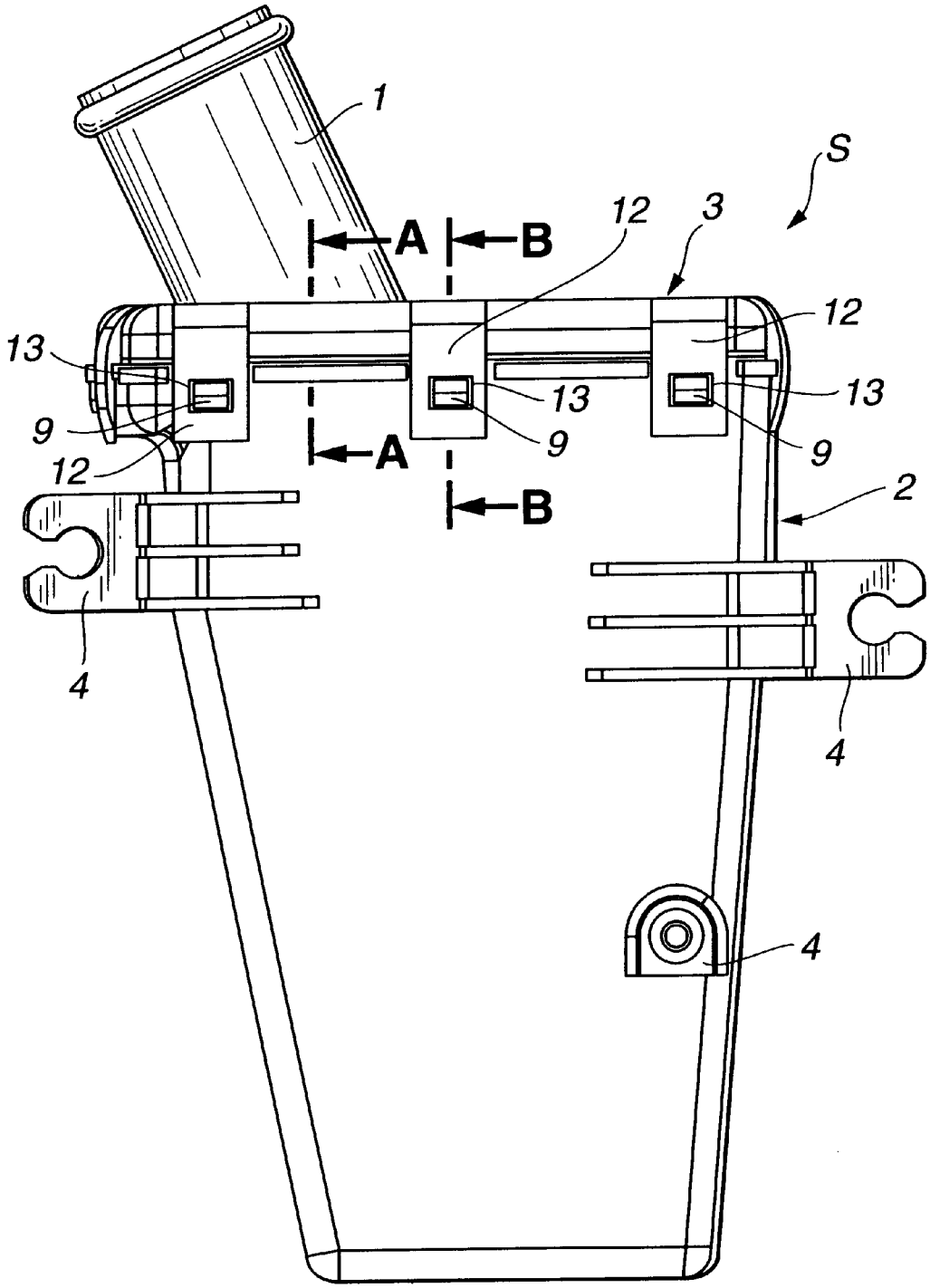
FIG. 3 is a front elevation similar to FIG. 2 but showing a state made after the assembly of the resonator type silencer of FIG. 1.
Figure 5:
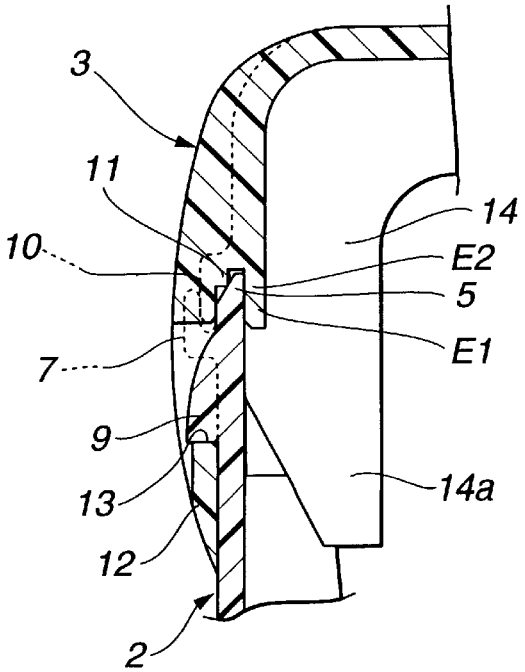
FIG. 5 is a cross-sectional view taken in the direction of the arrows substantially along the line B—B of FIG. 3.

The above resonator type silencer S is assembled as follows: First, as shown in FIGS. 1 and 2, the open end sections 2*a*, 3*a* of lower and upper cases 2,3 are placed opposite each other and then approached to each other. At this time, the downward projecting part 14*a* of each rib 14 of the upper case 3 is brought into slidable contact with the inner surface of the open end section 2*a* of the lower case 2, so that the open end sections 2*a*, 3*a* of the lower and upper cases 2,3 are guided to be accurately positioned. Then, under this state, the open end sections 2*a*, 3*a* of the lower and upper cases 2,3 are further close to each other. At this time, the tip end part of the linear projection 5 of the lower case 2 is inserted into the groove G2 of the upper case 3, while the locking piece section 12 runs on the inclined face 8 of the stopper projection 9 of the lower case 2 upon elastically deforming. Then, as shown in FIGS. 3 to 5, the seal edge portion 11 formed at the inner surface of the hook-like guide wall 10 of the upper case 3 is brought into tight contact with the inclined face 6 of the linear projection 5 of the lower case 2, while the stopper projection 9 of the upper case 3 is fitted into the window 13 of the locking piece section 12 so as to restrict displacement of the lower and upper cases 2,3 in a direction far from each other. At this time, the downward projecting portion 10*b* of the guide wall 10 of the upper case 3 is fitted into the groove G1 formed by the hook-like guide wall 7 of the lower case 2. Additionally, the inner surface of the end edge portion P1 of the lower case 2 is brought into tight contact with the outer surface of the end wall portion E2 of the upper case 3.

With the thus assembled resonator type silencer S, a so-called labyrinth structure is formed between the open end sections 2*a*, 3*a* of the upper and lower cases 2,3, more specifically by the end wall portion E2 of the upper case 3 fittingly inserted into the groove G2 of the upper case 3 and the downward projecting portion 10*b* of the upper case guide wall 10 fittingly inserted into the groove G1 of the lower case 2. Particularly by virtue of the fact that the seal edge portion 11 of the upper case 3 is brought into tight contact with the inclined face 6 of the linear projection 5, a tight seal condition can be stably maintained even in case that a slight production error or the like is made in the lower and upper cases 2,3, because the seal edge portion 11 can be suitably slidably moved on the inclined face 6 of the linear projection 5 of the lower case 2 during assembly of the resonator type silencer S. Here, although a pressing force applied between the seal edge portion 11 and the inclined face 6 acts in a manner to inwardly thrust the linear projection 5, the linear projection 5 can be prevented from being bent inward owing to the fact that the end edge wall E2 (of the upper case 3) contacting with the linear projection 5 is securely reinforced by the rib 14. As a result, an air-tight seal can be securely maintained between the lower and upper cases 2,3 even though pressure fluctuation is made within the resonator type silencer S.

Thus, joining the lower and upper cases 2, 3 can be accomplished to assemble the resonator type silencer S only by pushing down the upper case 3 onto the lower case 2 in a direction where the open end sections 3*a*, 2*a* of them approach, allowing the locking piece section 12 to come into engagement with the stopper projection 9. Accordingly, an assembly operation of the resonator type silencer S is largely facilitated. Besides, a special facility for the assembly operation and parts for the joining are not required, thereby making it possible to produce the resonator type silencer S at a low cost.

Each rib 14 formed at the inner surface of the upper case 3 can not only sustain a reaction force for sealing between the seal edge portion 11 of the upper case 3 and the linear projection 5 of the lower case 2, but also serve as a guide for assembling the upper case 3 to the lower case 2 during assembly of the resonator type silencer S since the lower part of the rib 14 extends downward so as to be flush with the inner surface of the end wall portion E2 of the open end section 3*a* of the lower case 3. Accordingly, this resonator type silencer S omits providing an independent guide required for assembling the upper and lower cases, thereby reducing the amount of the material for the resonator type silencer thus accomplishing weight-lightening of the resonator type silencer S.

Figure 6:
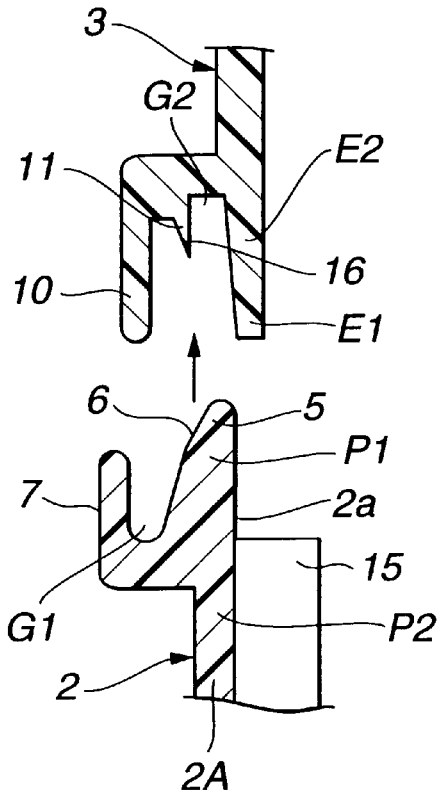
FIG. 6 is an enlarged fragmentary cross-sectional view similar to FIG. 4 but showing a second embodiment of the resonator type silencer according to the present invention in a state made before assembly.
Figure 7:
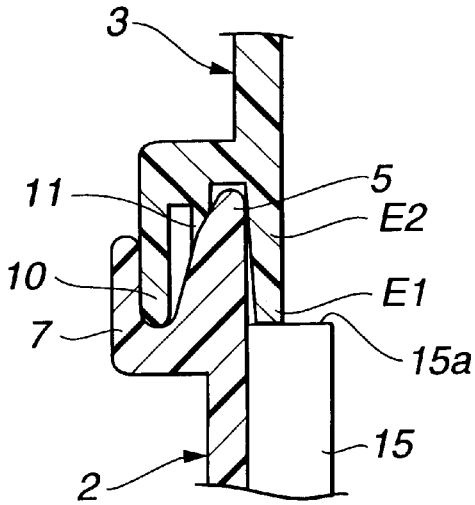
FIG. 7 is an enlarged fragmentary cross-sectional view similar to FIG. 6 but showing the resonator type silencer of FIG. 6 in a state made after the assembly.

FIGS. 6 and 7 illustrate an essential part of a second embodiment of the resonator type silencer S according to the present invention, which is similar to that of the first embodiment except for the shape of the seal edge portion 11 and a rib 15 formed in the lower case 2. More specifically, the seal edge portion 11 has a thin edge-like tip end part 16 which can be brought into tight contact with the inclined face 6 of the linear projection 5 of the rear case 2 in a manner to deform as shown in FIG. 7 when the lower and upper cases 2, 3 are assembled into the resonator type silencer S. Additionally, the rib 15 is formed at the inner surface of a main body 2A of the lower case 2 and extends upward to the open end section 2*a*. The rib 15 is perpendicular to the wall of the main body 2A. The rib 15 has an upper end edge 15*a* which is located to come into contact with the lower end edge of the end edge portion E1 of the upper case 3 as shown in FIG. 7 when the lower and upper cases 2, 3 are assembled, thereby preventing an excessive load from being applied to the edge-like tip end part 16 of the seal edge portion 11 of the upper case 3.

With this embodiment, the edge-like tip end part 16 of the seal edge portion 11 is brought into contact with the inclined face 6 of the linear projection 5 in the open end section 2*a* of the lower case 2. Accordingly, an air-tight condition can be securely maintained between the lower and upper cases 2, 3 even if a production error or the like is made in the lower and upper cases 2, 3. Furthermore, the rib 15 can prevent an excessive load from being applied onto the edge-like end part 16 of the seal edge portion 11. This effectively protects the seal-edge portion 11 from deterioration and therefore protects the whole resonator type silencer S from being degraded in air-tight sealing ability.

Figure 8:
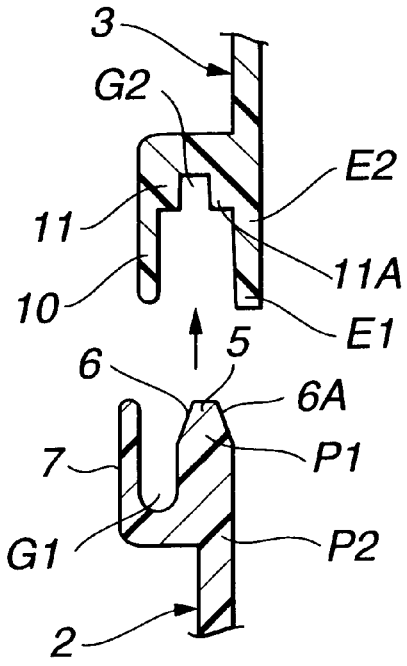
FIG. 8 is an enlarged fragmentary cross-sectional view similar to FIG. 6 but showing a third embodiment of the resonator type silencer according to the present invention in a state made before assembly.
Figure 9:
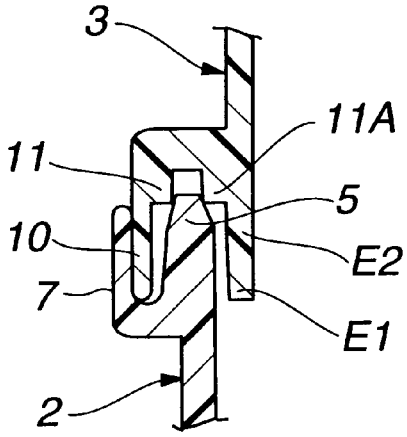
FIG. 9 is an enlarged fragmentary cross-sectional view similar to FIG. 8 but showing the resonator type silencer of FIG. 8 in a state made after assembly.

FIGS. 8 and 9 illiterate and essential part of a third embodiment of the resonator type silencer S according to the present invention, which is similar to that of the first embodiment except for the shape of the linear projection 5 of the lower case 2 and the cross-sectional shape of the upper part of the groove G2 formed in the upper case 3. More specifically, in this embodiment, the linear projection 5 in the end edge portion P1 of the lower case 2 has two opposite inclined faces 6 and 6A which are formed generally symmetrical, in which the inclined face 6A is sloped down in a direction toward the inner surface of the end wall portion P2. In the upper case 3, another seal edge portion 11A is formed at a linear portion (not identified) where the outward projecting portion 10*a* of the guide wall 10 is integral with the end edge portion E1 of the upper case 3. The seal edge portions 11, 11A can be respectively brought into tight contact with the inclined faces 6, 6A of the end edge portion P1 of the lower case 2.

With this arrangement, when the lower and upper cases 2, 3 are assembled to each other into the resonator type silencer S, the seal edge portions 11, 11A are respectively brought into press contact with the inclined faces 6, 6A of the end edge portion P1 of the lower case 2, thereby ensuring an air-tight seal between the open end sections 2*a*, 3*a* of the lower and upper cases 2, 3. Additionally, the linear projection 5 can be rigidly pressed by the two seal edge portion 11, 11A thus preventing the linear projection 5 from being displaced within the groove G2.

Figure 10:
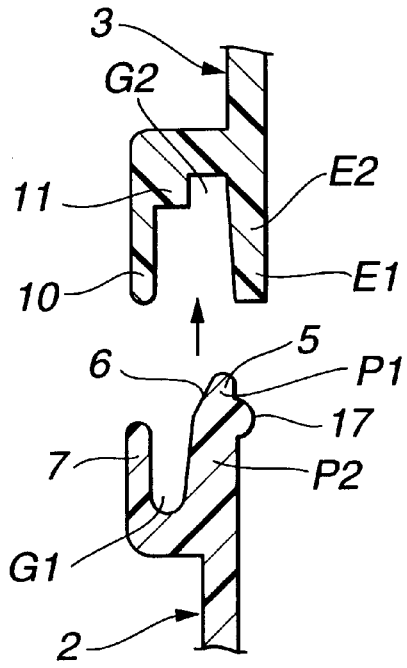
FIG. 10 is an enlarged fragmentary cross-sectional view similar to FIG. 6 but showing a fourth embodiment of the resonator type silencer according to the present invention in a state made before assembly.
Figure 11:
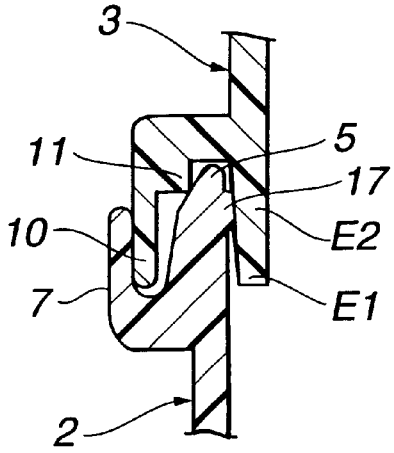
FIG. 11 is an enlarged fragmentary cross-sectional view similar to FIG. 10 but showing the resonator type silencer of FIG. 10 in a state made after the assembly.

FIGS. 10 and 11 illustrate an essential part of a fourth embodiment of the resonator type silencer S according to the present invention, which is similar to that of the first embodiment with the exception that a linear projection 17 having a semicircular cross-sectional shape is formed at the inner surface of the end wall portion P2 in the open end section 2*a* of the lower case 2.

With this arrangement, when the lower and upper cases 2, 3 are assembled to each other into the resonator type silencer S, the linear projection 17 formed at the inner surface of the end wall portion P2 is brought into contact with the outer surface of the end wall portion E2 of the upper case 3 as shown in FIG. 11, thereby effectively supporting the back-side of the inclined face 6 of the linear projection 5 of the lower case 2 thus ensuring an air-tight seal between the inclined face 6 of the linear projection 5 of the lower case 2 and the seal edge portion 11 of the upper case 3.

As appreciated from the above, according to the above embodiments, the open end sections of the upper and lower cases are brought into alignment with and contact with each other. Then, the linear projection of one case is inserted into the groove formed in the other case, in which the inclined face of the linear projection comes into tight contact with the seal edge portion formed in the groove, thereby accomplishing a tight seal between the upper and lower cases. Thus, the upper and lower cases can be readily joined with each other maintaining a tight seal condition, thereby making it unnecessary to use a large-scale facility only for joining the cases or separate parts for joining the cases. This lowers production cost for the resonator type silencer as compared with conventional techniques. Additionally, the labyrinth structure is formed between the linear projection and the groove while an edge contact is formed between the seal edge portion and the inclined face of the linear projection. This provides a secure air-tight seal between the upper said lower cases, thus stably obtaining the suppression effect on the intake air vibration. Particularly, sealing with the seal edge portion is effectively accomplished by causing the seal edge portion to contact with the inclined face formed on the linear projection, and therefore the air-tight seal can be securely maintained between the upper and lower cases upon the seal edge portion slidably displacing on the inclined face of the linear projection during assembly of the upper and lower cases even if a slight production error is made in the upper and/or lower cases. This reduces irregularity in vibration suppression effect among many products.

Wile the invention has been described above by reference to certain embodiments of the invention, the invention is not limited to the embodiments described above. Modifications and variations of the embodiments described above will occur to those skilled in the art, in light of the above teachings. For example, although the linear projection 5 has been shown and described as being formed at the side of the lower case 2 while the guide wall 10 and the seal edge portion 11 have been shown and described as being formed at the side of the upper case 3, it will be understood that, to the contrary, the linear projection 5 may be formed at the side of the upper case 3 while the guide wall 10 and the seal edge portion 11 may be formed at the side of the lower case 2.

What is claimed is:

1. A resonator type silencer for an intake system of an internal combustion engine of an automotive vehicle, comprising:

a first case having an open end section; and a second case fabricated separate from said first case, said second case having an open end section which is joinable with the open end section of said first case;

wherein the open end section of said first case includes an end edge portion having a linear projection extending along the end edge portion, said linear projection having an inclined face extending along the end edge portion and sloped down in a direction toward a surface of the open end section;

wherein the open end section of said second case includes an end wall portion, and a guide wall integral with the end wall portion and extending along an end edge portion of said open end section to define a groove extending along the end edge portion, and a seal edge portion formed at a surface of at least one of the guide wall and the end wall portion and extending along the end edge portion of said open end section of said second case so as to define a part of the groove, said seal edge portion being contactable with the inclined face of the linear projection of said end edge portion of said first case;

wherein said resonator type silencer further comprises an engagement mechanism including a projecting section formed integral with one of said first and second cases, and a receiving section for receiving the projecting section so that the projecting section and the receiving section are engageable with each other, the receiving section being formed integral with the other of said first and second cases.

2. A resonator type silencer as claimed in claim 1, wherein the inclined face of the linear projection is sloped down in a direction toward an outer surface of the open end section of said first case, wherein said second case includes a reinforcement rib formed at an inner surface of said second case and extending perpendicular to the end edge portion of said second case, the rib projecting over the end edge portion of said second case to form a projecting part which has an edge flush with an outer surface of the end wall portion of said second case.

3. A resonator type silencer as claimed in claim 1, wherein the projecting section of said engagement mechanism has an inclined face which is sloped down in a direction toward the end edge portion, wherein the receiving section of said engagement mechanism is projected over the end edge portion and elastic in a direction perpendicular to a plane parallel with the end wall portion so that the receiving section is slidably movable along the inclined face of the projecting section, the receiving section being formed with an opening into which the projecting section being capable of being fitted.

4. A resonator type silencer as claimed in claim 1, wherein said each of said first and second cases if formed of thermoplastic resin and fabricated as a one-piece structure.

5. A resonator type silencer as claimed in claim 1, wherein each of said first and second cases is generally cup-shaped so that the open end section extends endlessly along a periphery of each case.

6. A resonator type silencer as claimed in claim 1, wherein said guide wall includes an outward projecting portion integral with the end wall portion of said second case, and a vertically extending portion generally parallel with the end wall portion and integrally connected with the outwardly projecting portion to define the groove, wherein the seal edge portion of said second case is formed integral with at least one of the outwardly projecting portion and the vertically extending portion.

7. A resonator type silencer as claimed in claim 2, wherein said reinforcement rib is generally plate-shaped and formed perpendicular to a wall of said second case.

* * * * *